US008425090B2

(12) United States Patent
Foo

(10) Patent No.: US 8,425,090 B2
(45) Date of Patent: Apr. 23, 2013

(54) REFLECTOR CUP AND LED LAMP COMPRISING THE SAME

(75) Inventor: Onn Fah Foo, Hong Kong (CN)

(73) Assignee: Mass Technology (H.K.) Ltd., Kowloon (HK)

( * ) Notice: Subject to any disclaimer, the term of this patent is extended or adjusted under 35 U.S.C. 154(b) by 253 days.

(21) Appl. No.: 12/957,620

(22) Filed: Dec. 1, 2010

(65) Prior Publication Data

US 2011/0134644 A1 Jun. 9, 2011

(30) Foreign Application Priority Data

Dec. 3, 2009 (CN) ..... 2009 1 0251378

(51) Int. Cl.
*F21V 7/00* (2006.01)

(52) U.S. Cl.
USPC ..... 362/341; 362/342; 362/343; 362/241

(58) Field of Classification Search ..... 362/245, 362/241, 247, 345, 341, 343, 346, 348
See application file for complete search history.

(56) References Cited

U.S. PATENT DOCUMENTS 6,543,921 B2 * 4/2003 Natsume ..... 362/518
2001/0003506 A1 * 6/2001 Natsume ..... 362/518

* cited by examiner

*Primary Examiner* — Ali Alavi
(74) *Attorney, Agent, or Firm* — Rabin & Berdo, P.C.

(57) ABSTRACT

The present invention provides a reflector cup for a lamp, including a cup body, a cup top having an aperture through which a light source is inserted into the reflector cup, and a cup bottom provided with an opening for outputting lights from the light source. The cup body is provided with a plurality of recesses or protrusions that have a curvature different from that of a surface profile of the reflector cup. In one preferred embodiment, the cup body is provided with a plurality of grid veins arranged in a matrix, in each of the grid veins is formed a protruded or recessed curved surface. The curved surface may be spherical, cylindrical, conical or the like. The invention also provides a LED reflector lamp comprising the reflector cup.

12 Claims, 5 Drawing Sheets

NO DARK AREA

REFLECTOR CUP AND LED LAMP COMPRISING THE SAME

FIELD OF THE INVENTION

The present invention relates to a lighting fixture, and more particularly to a reflector cup and a light emitting diode (LED) lamp comprising the same.

BACKGROUND OF THE INVENTION

A LED lamp refers to a lighting fixture that uses one or more LEDs as a main light source. The LED is a solid state semiconductor device, and different kinds of LEDs can emit light of different wavelengths with various colors. One of the recent developments in the LED technology is to apply fluorescent powder on a blue LED so as to transform the blue LED into a white LED. The LED lamp has small size and light weight, and is encapsulated with epoxy resin such that it has high mechanical impact and vibration strength and is not vulnerable to break. Moreover, the LED lamp has a long brightness decay time so that its lifespan could be as long as 50 to 100 thousand hours, which is much longer than that of a conventional tungsten lamp (about 1 thousand hours) and a fluorescent lamp (about 10 thousand hours). The lifetime of the LED lamp may last for 5 to 10 years, therefore the cost for changing lighting fixtures would be greatly reduced. In addition, the LED lamp can be driven to emit light even at a very small current and consumes about half the energy of the fluorescent lamp to provide the substantially same illumination effect. Hence, the LED lamp has the advantages of electricity and energy saving.

Presently, a single-chip or multi-chip package of high power LED, AC LED, or the like are widely used in a LED bulb lamp. The single-chip package of high power LED finds wide applications in lighting fixtures that require light concentration and/or strong direction of light such as MR16 or LED projection lamp. The multi-chip package of high power LED can be found as a light source in a LED bulb lamp with 10 watts or above that take the place of energy saving lamps.

The LED lighting fixture is structurally similar to a reflective energy saving lamp except for the use of LED as a light emitting element. In general, the LED lighting fixture comprises a LED lamp board having a LED chip package, a fluorescent powder layer and the like; a housing; a circuitry for powering the LED chip; a reflector cup; a heat sink; and the like. FIG. 1A illustrates a perspective view of a LED reflector lamp of the prior art; and FIG. 1B is a bottom view of the LED reflector lamp of the prior art with LEDs used as a light-emitting element which are positioned above a label plate at the base of the LED lamp. The LED chip is powered to emit light which is transmitted to the fluorescent powder applied on the LED chip or the package, and the fluorescent powder is excited to emit white light or light with a predetermined color. In this LED lighting fixture, light emits from two sides of an upper portion of the label plate as shown in FIG. 1A and then are reflected by the reflector cup to emit forward.

However, in use, such a prior art LED lighting fixture would produce an illumination pattern having annular yellow zones that affects the illumination uniformity. This results in poor quality of illumination of the LED lamp, and has an adverse effect on the visual effect and its applications.

SUMMARY OF THE INVENTION

An object of the present invention is to provide a LED reflector lamp with a uniform illumination pattern. Another object of the present invention is to provide a reflector cup which enables the formation of a light-emitting area by reflecting light emitting from the LEDs.

To attain the above objects, there is provided a reflector cup that has grid veins with a curvature to realize uniform illumination pattern of the LED lamp.

According to one aspect of the present invention, a reflector cup for a lamp is provided, which comprises a cup body, a cup top having an aperture through which a light source is inserted into the reflector cup, and a cup bottom provided with an opening for outputting lights from the light source, characterized in that the cup body is provided with a plurality of recesses or protrusions that have a curvature.

The cup body may be of paraboloidal or hyperboloidal configuration in rotational symmetry, or of other suitable configuration, for instance spherical configuration, stepped configuration or rectangular configuration; or even of composite curved configuration or the like. The cup body could be divided into several parts for receiving other members, or for the convenience of manufacture or installation processes.

In one preferred embodiment of the invention, the cup body of the reflector cup are provided with a plurality of grid veins arranged in a matrix, in each of the grid veins is formed a protruded or recessed curved surface. Preferably the curvature of the curved surface is defined by a straight line length A-B of a side of the grid vein and a height D-C extending from an apex of the curved surface to the side of the grid veil, wherein the height D-C is 0.02 (A-B) to 0.1 (A-B), and preferably 0.02 (A-B) to 0.04 (A-B). Generally, the straight line length A-B of the side of the grid vein is 1 mm to 10 mm, so the height D-C is 0.02 mm to 1 mm, and preferably 0.02 mm to 0.4 mm.

The curvature of the protruded grid vein is preferably of the size that a ratio of height to base width of the curvature is about 0.02 to 0.1, and preferably 0.02 to 0.04, which means the height D-C is equal to 0.02 (A-B) to 0.1 (A-B), and preferably 0.02 (A-B) to 0.04 (A-B). If the ratio is bigger than 0.1, the light intensity will be affected although the uniform distribution of light is maintainable.

The reflector cup can not only be used in a LED reflector lamp, but also in other types of reflector lamp such as reflective energy saving lamp or fluorescent lamp, incandescent lamp, or the like. The reflector cup of the invention can even be used in all types of lighting fixture.

According to another aspect of the invention, a LED reflector lamp is provided, which comprises a housing in which a LED lamp board acting as a light source and a circuitry for powering the LED reflection lamp are received, a reflector cup mounted on the housing and for reflecting lights from the LED lamp board to form light output, and a heat sink for dispersion of heat energy generated by the LED lamp board, characterized in that the reflector cup is a reflector cup described above.

According to the present invention, the LED lamp board comprises a LED chip package and a layer of fluorescent powder applied on the surface thereof. Preferably, the LED lamp board comprises a plurality of LED chips arranged in an array, and the plurality of LED chips are formed on a semiconductor substrate or on a plurality of semiconductor substrates that are interconnected together.

The reflector cup and LED reflector lamp according to the present invention are able to provide uniform illumination patterns while maintaining the light intensity.

DETAILED DESCRIPTION OF THE INVENTION

A LED reflector lamp comprising a lamp board on which a plurality of LED chips are mounted and a reflector cup having grid veins will be described hereinbelow with reference to the accompanying drawings.

The present invention is based on the finding that the formation of annular yellow zones found in the illumination pattern produced by the LED reflector lamp of the prior art is caused by the array arrangement of multiple chips mounted on the LED lamp board.

Figure 1A:
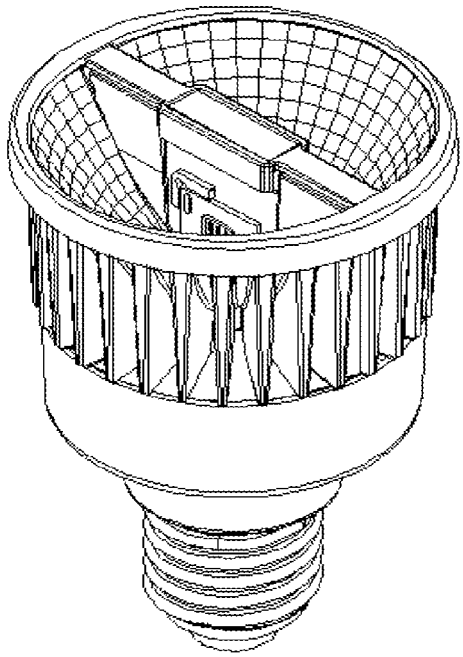
Fig. 1A (Prior Art)
FIG. 1A is a perspective view of a LED reflector lamp of the prior art.
Figure 1B:
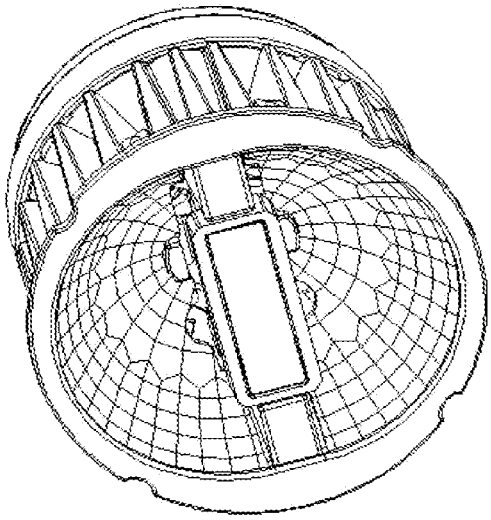
Fig. 1B (Prior Art)
FIG. 1B is a bottom view of the LED reflector lamp of the prior art showing the reflector cup used therein.
Figure 1C:
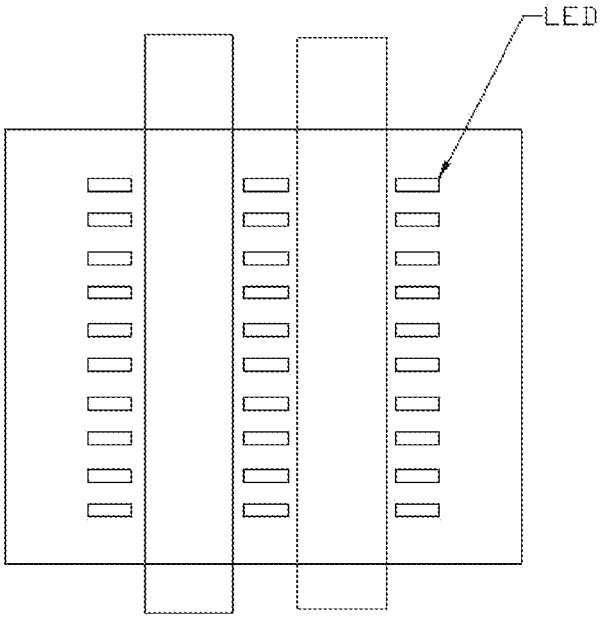
Fig. 1C (Prior Art)
FIG. 1C is a schematic view of an array of LED chips arranged on the LED lamp board of the LED reflector lamp of the prior art.

FIG. 1C is a schematic view of an array of LED chips arranged on the LED lamp board of the LED reflector lamp of the prior art. As shown in this figure, the biggest rectangular box represents a LED chip substrate, and each of the small rectangular boxes represents a LED chip. This figure shows 3×10 LED chips which can be mounted on a single chip substrate or can be formed by multiple small chip arrays. The respective columns of chips are spaced at a relatively long distance, which is, for instance, represented using two rectangles in the vertical direction of FIG. 1C; and the respective lines of chips are spaced at a relative short distance.

Figure 2:
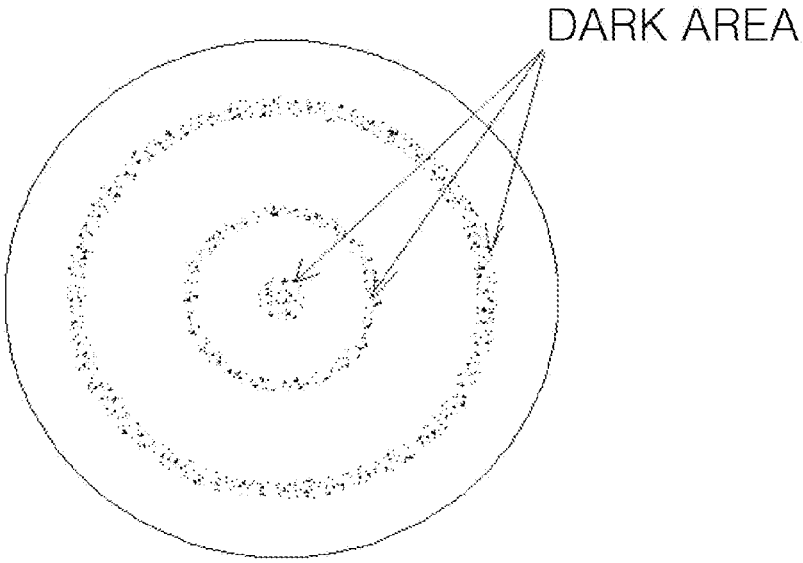
Fig. 2 (Prior Art)
FIG. 2 is an illumination pattern produced by the LED reflector lamp of the prior art.

The reflector cup of the LED reflector lamp of the prior art has a smooth paraboloidal or hyperboloidal surface, which is very similar to that of a reflective fluorescent lamp or energy saving reflector lamp. However, the reflector cup of the reflector LED lamp is divided into two halves so that a LED lamp board is sandwiched therebetween. The areas between each two columns of the LED chip array in the LED reflector lamp are non-light-emitting areas which may result in non-light-emitting or weak light emitting areas of similar shape on the fluorescent layer. These non-light-emitting areas would be reflected by the reflector cup to produce yellowish dark areas in the illumination pattern of the LED lamp as shown in FIG. 2, with a result of an uneven illumination pattern.

In order to solve the foregoing problem, the present invention provides a reflector cup for a lamp, which comprises a cup body, a cup top having an aperture through which a light source is inserted into the reflector cup, and a cup bottom provided with an opening for outputting lights from the light source, characterized in that the cup body is provided with a plurality of recesses or protrusions that have a curvature.

The cup body may be of paraboloidal or hyperboloidal configuration in rotational symmetry, or of other suitable configuration, for instance spherical configuration, stepped configuration or rectangular configuration; or even of composite curved configuration or the like. The cup body could be divided into several parts for receiving other members, or for the convenience of manufacture or installation processes.

Figure 3:
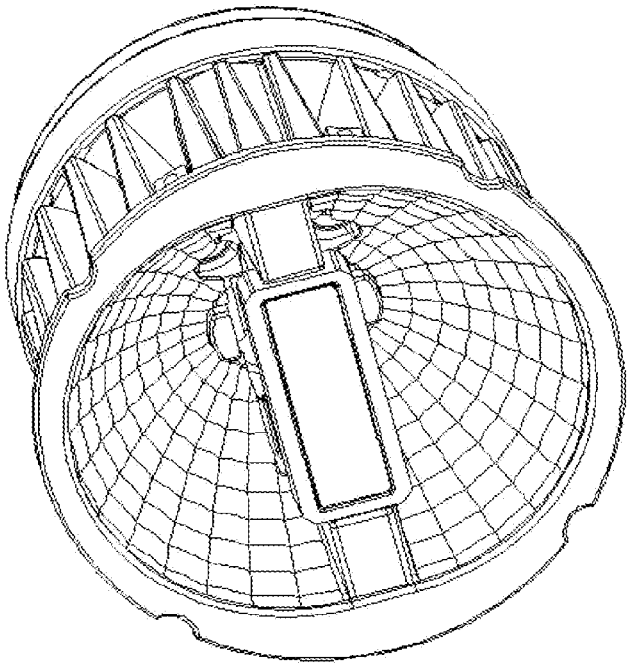
FIG. 3 is a perspective view of a LED reflector lamp constructed according to the present invention.

As shown in FIG. 3, the grid veins of the reflector cup are designed to have a protruded curvature to allow uniform distribution of the reflected lights, such that the illumination pattern projected by the reflector cup is uniform and no yellowish area is produced, while the light intensity remains unaffected.

Figure 5:
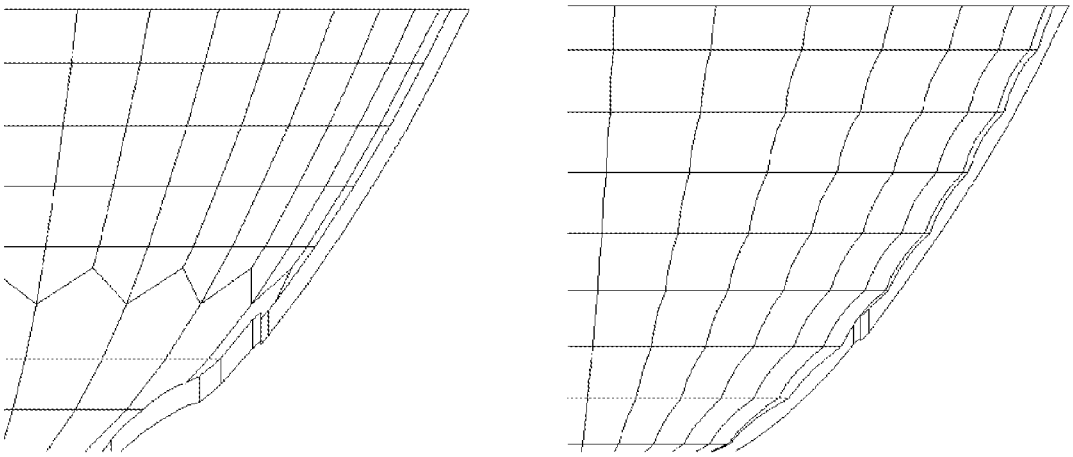
FIG. 5 is a view showing partial comparison of the reflector cup constructed according to the present invention with the reflector cup of the prior art.

The reflector cup is designed in such a manner that each of the grid veins has a protruded curved surface. The partial enlarged views of FIG. 5 illustrate respectively a portion of the reflector cups, wherein the surface of the reflector cup of the prior art is shown on the left and the surface of the reflector cup of the present invention is shown on the right. It can be seen from FIG. 5 that the surface of the reflector cup of the prior art is smooth with plain grid veins. The reflector cup of the prior art is machined by a rotary extrusion process, and the grid veins thereof are molded through the mold used in the rotary extrusion process. The surface of such a reflector cup is paraboloidal or hyperboloidal, therefore four sides of each grid vein are all curved. The grid vein side extending from the cup top to the cup bottom is a paraboloidal/hyperboloidal curve that gradually diverges, and the grid vein side in parallel with the cup bottom is a parallel circle. In the reflector cup of the prior art, the surfaces of all the grid veins form together a smooth paraboloidal or hyperboloidal surface.

According to the present invention, the reflector cup are provided with a plurality of grid veins which are arranged in a matrix, in each of the grid veins is formed a protruded curved surface (cylindrical surface or spherical surface) that has a curvature. When viewed from the bottom of the LED reflector lamp, each of the grid veins forms a small concave mirror, namely the curved surface protrudes inward. In the reflector cup of the present invention, all the protruded curved surfaces of the grid veins lead to the formation of a matte paraboloidal or hyperboloidal overall surface of the reflector cup, in particular to the formation of an overall surface with relief patterns, but the reflector cup still has an overall surface profile of paraboloid or hyperboloid. In short, it can be understood that the reflector cup of the present invention relates to improvements in the reflector cup of the prior art by causing the curved surface of each of the grid veins of the reflector cup of the prior art to protrude inward or outward to form a curved surface (cylindrical surface or spherical surface) that has a curvature different from that of the paraboloid or hyperboloid of the surface profile of the reflector cup.

A reflector cup of paraboloidal configuration will be taken as an example to describe the design relating to the curvature of the curved surface of the grid vein.

Figure 6:
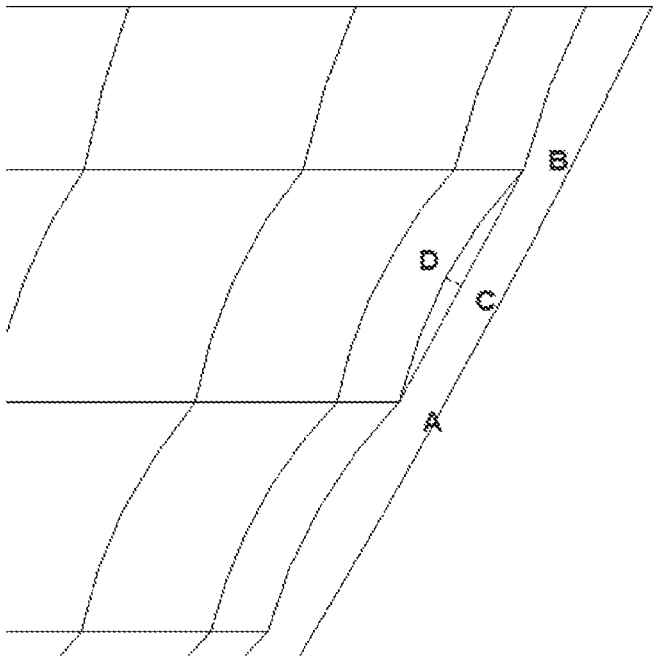
FIG. 6 is a schematic view showing how to calculate the curvature of the reflector cup of the present invention.

FIG. 6 illustrates a partial enlarged view of the reflector cup of the invention showing that the reflector cup is inverted, with the cup bottom being at the upper side of the figure and the cup top being at the lower side of the figure. The horizontal direction of the figure is parallel to the cup bottom, and each box in this figure represents a grid vein. The grid vein has upper and lower sides that are parallel to the cup bottom, and lateral sides that are defined by a parabolic curve extending from the cup top to the cup bottom. Each of the grid veins has end points A, B which are located at the paraboloidal surface of the reflector cup, and a curved surface ADB.

In FIG. 6, the length of the straight line ACB of the lateral side of the grid vein is expressed by A-B which may be varied from 1 mm to 10 mm depending on the size of the reflector cup. The curved surface ADB has an apex which is expressed by D, the height from the apex D to the straight line ACB is D-C which is about 0.02-1 mm. The height D-C is proportionally equal to 0.02 (A-B) to 0.1 (A-B). Preferably, the height D-C is about 0.02-0.04 mm, that is, the height D-C is 0.02 (A-B) to 0.04 (A-B). It should be noted that the straight line ABC is virtual, which is provided for the purpose of calculation of the curvature, and which does not exist in the practical product of the reflector cup. The height of the curved surface may be varied in the reflector cups of different sizes.

The curvature of the protruded curve surface is preferably of the size that a ratio of height to base width of the curvature is about 0.02 to 0.1, and preferably 0.02 to 0.04, namely, the height D-C is equal to 0.02 (A-B) to 0.1 (A-B), and preferably 0.02 (A-B) to 0.04 (A-B). If the ratio is bigger than 0.1, the light intensity will be affected although the uniform distribution of light is maintainable.

The protruded curved surface may be of spherical, cylindrical or conical configuration, or of other suitable configuration. This can be determined according to the requirements for light concentration and/or the processing technology of the LED reflector lamp. In the case of the spherical or conical surface, point C should be located at the center of the plane where four end points of the grid vein are situated, and point D should be located on the perpendicular line of the plane where four end points of the grid vein are situated, and this perpendicular line passes through the point C. The four end points and the curvature height D-C of the grid vein enable to determine the overall shape of the curved surface further in light of the configuration of the curved surface on the basis of geometrical principles.

Alternatively, the curved surface could protrude outward to form a convex mirror when viewed from the bottom of the reflector cup. This also can realize the similar technical effects described above.

It would be appreciated that the reflector cup of the invention is not limited to paraboloidal configuration. On the reflector cup of hyperboloidal configuration or any suitable configuration, the grid veins and the protruded/recessed curved surfaces can be formed to allow the elimination of dark or yellowish areas in the illumination pattern of the reflector lamp to provide an uniform illumination pattern.

The reflector cup can not only be used in a LED reflector lamp, but also in other types of reflector lamp such as reflective energy saving lamp or fluorescent lamp, incandescent lamp, or the like. The reflector cup of the invention can even be used in all types of lighting fixture.

Thus, the invention also provides a LED reflector lamp, which comprises a housing in which a LED lamp board acting as a light source and a circuitry for powering the LED reflection lamp are received, a reflector cup mounted on the housing and for reflecting lights from the LED lamp board to form light output, and a heat sink for dispersion of heat energy generated by the LED lamp board, characterized in that the reflector cup is a reflector cup described above.

Figure 4:
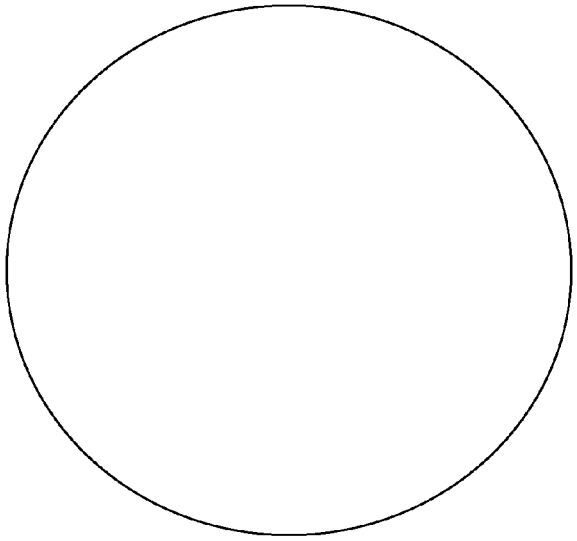
FIG. 4 is an illumination pattern produced by the LED reflector lamp according to the present invention.

According to the present invention, the LED lamp board comprises a LED chip package and a layer of fluorescent powder applied on the surface thereof. Preferably, the LED lamp board comprises a plurality of LED chips arranged in an array, and the plurality of LED chips can be formed on a semiconductor substrate or on a plurality of semiconductor substrates that are interconnected together FIG. 4 illustrates the illumination pattern of the LED reflector lamp constructed according to the present invention, and the LED reflector lamp comprises a reflector cup having a curved surface described above. The lights emitting from the LED lamp board are reflected by the reflector cup to emit out of the reflector lamp. As illustrated, the illumination pattern generated after the reflection of the reflector cup is very uniform. This is because the curved surface or curvature of the grid veins of the reflector cup allows uniform distribution of the lights emitting from the LED light source, which eliminates the yellowish areas as found in the reflector lamp of prior art, while maintaining the output light intensity of the reflector lamp.

It should be understood that the above description is provided merely for illustrating the principle of the present invention, and should not be construed as limiting the present invention to the specific configurations and operations as described and shown hereinbefore. While many corresponding modifications as well as variations can be made to the technical solutions of the present invention by a person skilled in the art without departing from the teachings thereof, all such modifications, variations and equivalents should fall within the scope of the present invention.

What is claimed is:

1. A reflector cup for a lamp, comprising a cup body, a cup top having an aperture through which a light source is inserted into the reflector cup, and a cup bottom provided with an opening for outputting lights from the light source, characterized in that the cup body is provided with a plurality of recesses or protrusions that have a curvature different from that of a surface profile of the reflector cup, wherein the cup body of the reflector cup is provided with a plurality of grid veins arranged in a matrix, in each of the grid veins is formed a protruded or recessed curved surface, and the curvature of the curved surface is defined by a straight line length A-B of a side of the grid vein and a height D-C extending from an apex of the curved surface to the side of the grid veil, and the height D-C is 0.02(A-B) to 0.1(A-B).

2. A reflector cup according to claim 1, wherein the length A-B of the side of the grid vein is 1 mm to 10 mm.

3. A light emitting diode (LED) reflector lamp, comprising a housing in which a LED lamp board acting as a light source and a circuitry for powering the LED reflection lamp are received, a reflector cup mounted on the housing and for reflecting lights from the LED lamp board to form light output, and a heat sink for dispersion of heat energy generated by the LED lamp board, characterized in that the reflector cup is a reflector cup according to claim 2.

4. A reflector cup according to claim 1, wherein the height D-C is 0.02(A-B) to 0.04 (A-B).

5. A reflector cup according to claim 4, wherein the cup body is of paraboloidal or hyperboloidal configuration in rotational symmetry, or of other suitable configuration.

6. A reflector cup according to claim 4, wherein the length A-B of the side of the grid vein is 1 mm to 10 mm.

7. A light emitting diode (LED) reflector lamp, comprising a housing in which a LED lamp board acting as a light source and a circuitry for powering the LED reflection lamp are received, a reflector cup mounted on the housing and for reflecting lights from the LED lamp board to form light output, and a heat sink for dispersion of heat energy generated by the LED lamp board, characterized in that the reflector cup is a reflector cup according to claim 4.

8. A reflector cup according to claim 4, wherein the curved surface is spherical, cylindrical, or conical.

9. A reflector cup according to claim 1, wherein the cup body is of paraboloidal or hyperboloidal configuration in rotational symmetry, or of other suitable configuration.

10. A reflector cup according to claim 1, wherein the curved surface is spherical, cylindrical, or conical.

11. A light emitting diode (LED) reflector lamp, comprising a housing in which a LED lamp board acting as a light source and a circuitry for powering the LED reflection lamp are received, a reflector cup mounted on the housing and for reflecting lights from the LED lamp board to form light output, and a heat sink for dispersion of heat energy generated by the LED lamp board, characterized in that the reflector cup is a reflector cup according to claim 1.

12. A LED reflector lamp according to claim 11, wherein the LED lamp board comprises a plurality of LED chips arranged in an array and a layer of fluorescent powder applied on a surface of the LED lamp board.

* * * * *